US009469041B2

(12) United States Patent
King et al.

(10) Patent No.: US 9,469,041 B2
(45) Date of Patent: Oct. 18, 2016

(54) METHODS AND EQUIPMENT FOR CUTTING FOOD PRODUCTS

(71) Applicant: Urschel Laboratories Inc., Valparaiso, IN (US)

(72) Inventors: Daniel Wade King, Valparaiso, IN (US); Michael Scot Jacko, Wanatah, IN (US); Thomas R. Mahaffey, II, Francesville, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 407 days.

(21) Appl. No.: 13/868,763

(22) Filed: Apr. 23, 2013

(65) Prior Publication Data

US 2013/0276604 A1 Oct. 24, 2013

Related U.S. Application Data

(60) Provisional application No. 61/636,769, filed on Apr. 23, 2012.

(51) Int. Cl.
*B26D 1/03* (2006.01)
*B26D 3/26* (2006.01)
(Continued)

(52) U.S. Cl.
CPC . *B26D 1/03* (2013.01); *B26D 3/26* (2013.01); *B26D 7/0691* (2013.01); *B26D 1/0006* (2013.01); *B26D 2001/006* (2013.01); *B26D 2001/0033* (2013.01); *B26D 2003/288* (2013.01); *Y10T 83/0586* (2015.04); *Y10T 83/9457* (2015.04)

(58) Field of Classification Search
CPC ..... B26D 1/03; B26D 7/06; B26D 7/014; B26D 7/0691; B26D 3/26; B26D 1/006; B26D 2003/288; B26D 2001/006; B26D 3/283; B26D 2001/0033; Y10T 83/6473; Y10T 83/9464; Y10T 83/9493; Y10T 83/6481; Y10T 83/9457; Y10T 83/0586
USPC ..... 83/53, 52, 403, 404.3, 698, 856, 404.1, 83/404.2, 865, 592, 932, 425.3, 857, 83/356.3, 408, 666, 698.11; 241/291, 241/291.1, 37.5, 199.12
See application file for complete search history.

(56) References Cited

U.S. PATENT DOCUMENTS 2,580,526 A 1/1952 Dawson
2,769,714 A 11/1956 Stahmer
(Continued)

FOREIGN PATENT DOCUMENTS

CN 2558497 7/2003

OTHER PUBLICATIONS

European extended Search Report dated Feb. 18, 2016.

*Primary Examiner* — Ghassem Alie
(74) *Attorney, Agent, or Firm* — Hartman Global IP Law; Gary M. Hartman; Domenica N. S. Hartman

(57) ABSTRACT

Knife assemblies and methods therefor that are adapted to be used with a cutting apparatus capable of producing a variety of shaped food products having large amplitudes, for example, sliced, shredded, and strip-cut food products. The knife assembly is adapted for cutting food product includes a knife having a corrugated shape to produce a large-amplitude food product slice having a periodic shape and at least one julienne tab metallurgically joined to the knife adapted to cut the food product slice into strips.

6 Claims, 19 Drawing Sheets

(51) Int. Cl.

| | |
|---|---|
| ***B26D 7/06*** | (2006.01) |
| *B26D 1/00* | (2006.01) |
| *B26D 3/28* | (2006.01) |

(56) References Cited

U.S. PATENT DOCUMENTS

| | | | | |
|---|---|---|---|---|
| 2,961,024 | A | 11/1960 | Urschel et al. | |
| 3,139,129 | A * | 6/1964 | Urschel | B26D 1/0006 83/13 |
| 3,392,768 | A * | 7/1968 | Anliker | A47J 43/046 83/113 |
| 3,395,742 | A * | 8/1968 | Sanders | B26D 1/0006 83/698.41 |
| 4,508,739 | A * | 4/1985 | Ryan | 426/144 |
| 4,523,503 | A | 6/1985 | Julian et al. | |
| 4,590,835 | A * | 5/1986 | Matsuo | 83/698.41 |
| 4,601,227 | A | 7/1986 | Fitzwater et al. | |
| 4,680,191 | A * | 7/1987 | Budd et al. | 426/439 |
| 5,095,875 | A * | 3/1992 | Morris | B26D 1/0006 83/403 |
| 7,032,487 | B2 | 4/2006 | Tochigi et al. | |
| 7,178,440 | B2 * | 2/2007 | Bucks | 83/663 |
| 2001/0008097 | A1 | 7/2001 | Jacko | |
| 2005/0150345 | A1 | 7/2005 | Bucks | |
| 2005/0217117 | A1 * | 10/2005 | Willis | 30/114 |
| 2010/0236372 | A1 | 9/2010 | Desailly et al. | |
| 2013/0183415 | A1 * | 7/2013 | Barber | A23L 1/0073 426/144 |

* cited by examiner

METHODS AND EQUIPMENT FOR CUTTING FOOD PRODUCTS

CROSS REFERENCE TO RELATED APPLICATIONS

This application claims the benefit of U.S. Provisional Application No. 61/636,769, filed Apr. 23, 2012, the contents of which are incorporated herein by reference.

BACKGROUND OF THE INVENTION

The present invention generally relates to methods and equipment for cutting food products, and shapes of food products produced thereby.

Various types of equipment are known for slicing, shredding and granulating food products, such as vegetable, fruit, dairy, and meat products. A widely used line of machines for this purpose is commercially available from Urschel Laboratories, Inc., under the name Urschel Model CC®. Partial views of cutting heads adapted for use with various embodiments of Model CC® machines are represented in FIGS. 1, 2, and 7. The Model CC® machine line provides versions of centrifugal-type cutting apparatuses that are capable of producing uniform slices, strip cuts, shreds and granulations of a wide variety of food products at high production capacities. The cutting apparatus generally comprise one or more knife assemblies arranged in sets spaced around the circumference of their cutting heads.

FIGS. 1 and 2 represent an existing Model CC® cutting head 10 equipped with shaped knives 12 that are adapted for producing shaped (as opposed to flat) sliced food products. FIGS. 3 and 4 visually represent sequential corrugated knives 12 in phase alignment for use with the cutting head 10 of FIGS. 1 and 2. FIGS. 5 and 6 represent examples of food products that can be produced with the cutting head 10 of FIGS. 1 and 2 and with phase-aligned knives similar to those of FIGS. 3 and 4.

FIG. 7 represents an existing Model CC® cutting head 20 equipped with shaped knives 12 that are adapted for producing shaped shredded food products. The shaped knives 12 are arranged to be out of phase alignment by offsetting the knives 12 with precision spacers 22. FIG. 8 visually represents the sequential knives 12 as being 180 degrees out of phase alignment for use with the cutting head 20 of FIG. 7. The radial distance of a valley 18 of a leading knife 12 is equal to the radial distance of the corresponding peak 16 of the next trailing knife 12 in the sequence to produce a "full shred." As used herein, the radial direction ($R_d$) is in reference to the mounting of the knives in the cutting head. FIGS. 9 through 12 represent examples of food products that can be produced with the cutting head 20 of FIG. 7 and with knives 180 degrees out of phase alignment similar to what is represented in FIG. 8.

FIG. 13 visually represents the sequential knives 12 as being 180 degrees out of phase alignment for use with the cutting head 20 of FIG. 7. As the radial position of the knives 12 increase further from the full shred position, the cutting planes of the knives 12 begin to overlap to produce the reduced shred food products. FIGS. 14 through 21 represent examples of food products that can be produced with the cutting head 20 of FIG. 7 and with overlapping knives 180 degrees out of phase alignment similar to what is represented in FIG. 13.

FIG. 22 represents an existing Model CC® cutting head 30 equipped with knife assemblies that are adapted for producing flat (as opposed to shaped) strip-cut food products. FIG. 23 represents a knife assembly 33 that can be used with the cutting head 30 of FIG. 22, and comprising a flat slicing knife 32 assembled with an additional knife 36 (referred to herein as a "julienne" knife) equipped with individual knives that are oriented roughly perpendicular to the flat slicing knife 32 to produce strip-cut flat food products. In operation, a leading edge 34 of the flat slicing knife 32 cuts a slice of the food product, followed by the julienne knife 36 that cuts the slice into strips. FIGS. 24 through 27 represent examples of food products that can be produced with the cutting head 30 of FIG. 22 and with knifes similar to what is represented in FIG. 23.

FIG. 28 represents a knife assembly 38 adapted for use with the cutting head 30 of FIG. 22 comprising a shaped (corrugated) slicing knife 40 in combination with a julienne knife 44 secured between a clamp 46 and a knife holder 42. By arranging sequential knives 40 to be in phase alignment, shaped (as opposed to flat) strip-cut food products are produced. FIGS. 29 through 32 represent examples of food products that can be produced with the cutting head 30 of FIG. 22 and with knife assemblies similar to what is represented in FIG. 28.

While it should be evident that the Model CC® line of machines and knives of the type discussed above in reference to FIGS. 1 through 28 can be used to produce various types of cut food products, manufacturing challenges arise if the desired amplitude (peak-to-peak dimension) of a shaped (including sliced, shredded, and strip-cut) food product is increased. Therefore, improved equipment and methods are desirable for producing shaped food products similar to those discussed above for food products having large amplitudes.

BRIEF DESCRIPTION OF THE INVENTION

The present invention provides knife assemblies and methods therefor that are adapted to be used with a cutting apparatus, for example, the Urschel Model CC® line of machines, and are capable of producing a variety of shaped food products having large amplitudes, for example, sliced, shredded, and strip-cut food products whose amplitudes exceed 0.1 inch (about 2.5 mm), including amplitudes of about 0.2 inch (about 5 mm) or more.

According to a first aspect of the invention, a knife assembly adapted for cutting food product includes a knife having a corrugated shape to produce a large-amplitude food product slice having a periodic shape and at least one julienne tab metallurgically joined to the knife adapted to cut the food product slice into strips.

According to a second aspect of the invention, a method of producing shaped food products includes providing a cutting apparatus comprising at least two sequential knives each having a corrugated shape to produce large-amplitude food product slice having a periodic shape, arranging the sequential knives to be out of phase alignment with a gap provided between the radial position of the sequential knives, and operating the cutting apparatus to produce a food product slice having first portions with a cross-sectional thickness measured as a radial distance between sequential knives that is defined by the gap and less than a cross-sectional thickness of second portions of the food product slice.

According to a third aspect of the invention, a method of producing shaped food products includes providing a cutting apparatus comprising at least two sequential knives having a corrugated shape with flat peaks and/or valleys and operating the cutting apparatus to produce a large-amplitude food product slice having a periodic shape with flat peaks and/or valleys.

A technical effect of the invention is the ability to produce shaped food products having large amplitudes. In particular, it is believed that the equipment and phase alignments of the present invention can be used to produce a variety of shaped food products, for example, sliced, shredded, and strip-cut food products, having large amplitudes.

Other aspects and advantages of this invention will be better appreciated from the following detailed description.

DETAILED DESCRIPTION OF THE INVENTION

The present invention provides knife assemblies and methods therefor that may be used with various types of equipment for slicing, shredding and granulating food products, such as vegetable, fruit, dairy, and meat products. Although the knives and methods are described hereinafter in reference to an Urschel Model CC® machine equipped with a cutting head similar to those represented in FIGS. 1, 2, 7, and 22, it will be appreciated that the knife assemblies and methods therefor are generally applicable to other types of equipment, such as, but not limed to, other types of centrifugal-type cutting apparatuses that are capable of producing uniform slices, strip cuts, shreds, and granulations of a wide variety of food products. The present invention is particularly suitable for producing large-amplitude, preferably 2.5 mm or more, shaped sliced food products having periodic shapes and/or shaped shredded or shaped strip-cut food products.

Figure 23:
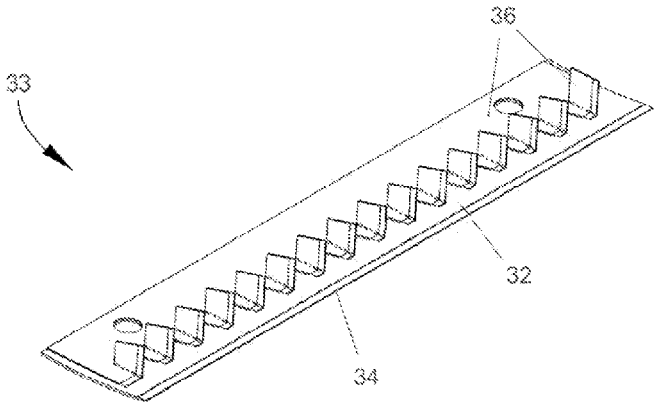
FIG. 23 (Prior Art)
FIG. 23 is a perspective view representing a knife assembly that can be used with the cutting head of FIG. 22, and comprises a flat slicing knife and a julienne knife to produce strip-cut flat food products.
Figure 24:
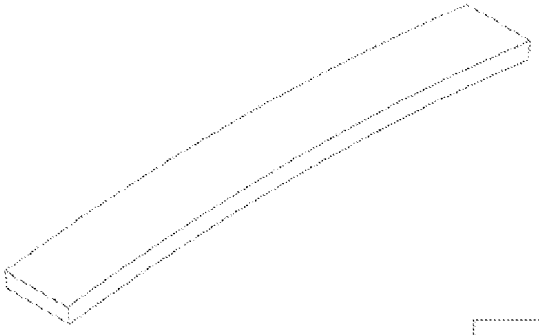
FIG. 24 (Prior Art)
FIGS. 24 through 27 are perspective and cross-sectional views representing examples of food products that can be produced with the cutting head of FIG. 22 and with knife assemblies of the type represented in FIG. 23.
Figure 25:
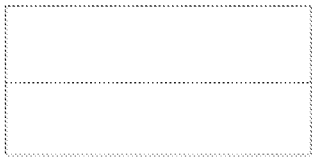
FIG. 25 (Prior Art)
Figure 26:
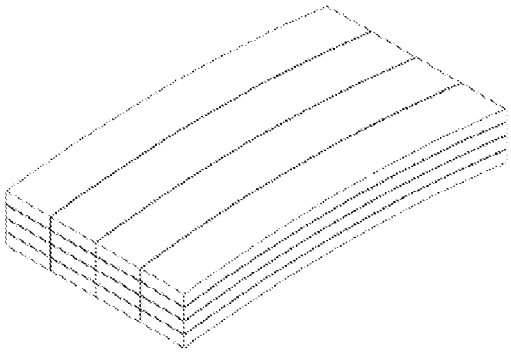
FIG. 26 (Prior Art)
Figure 27:
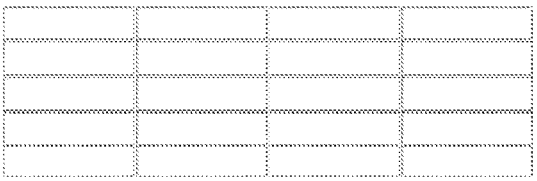
FIG. 27 (Prior Art)
Figure 28:
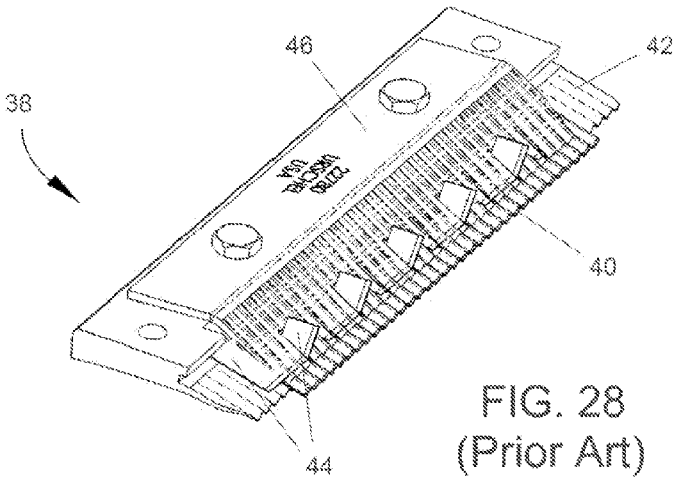
FIG. 28 (Prior Art)
FIG. 28 is a perspective view representing a knife assembly that can be used with the cutting head of FIG. 22, and comprises a shaped knife and a julienne knife to produce shaped strip-cut food products.
Figure 29:
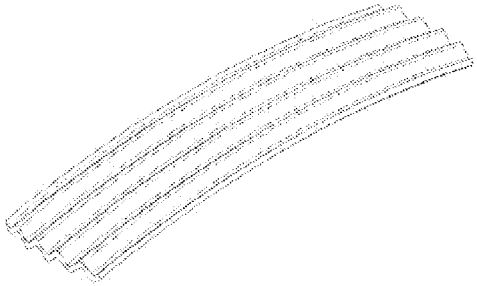
FIG. 29 (Prior Art)
FIGS. 29 through 32 are perspective and cross-sectional views representing examples of food products that can be produced with the cutting head of FIG. 22 and with knife assemblies similar to what is represented in FIG. 28.
Figure 30:
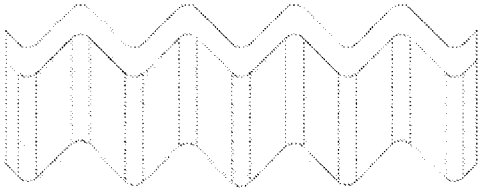
FIG. 30 (Prior Art)
Figure 31:
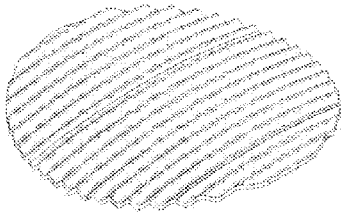
FIG. 31 (Prior Art)
Figure 32:
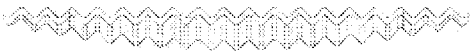
FIG. 32 (Prior Art)
Figure 33:
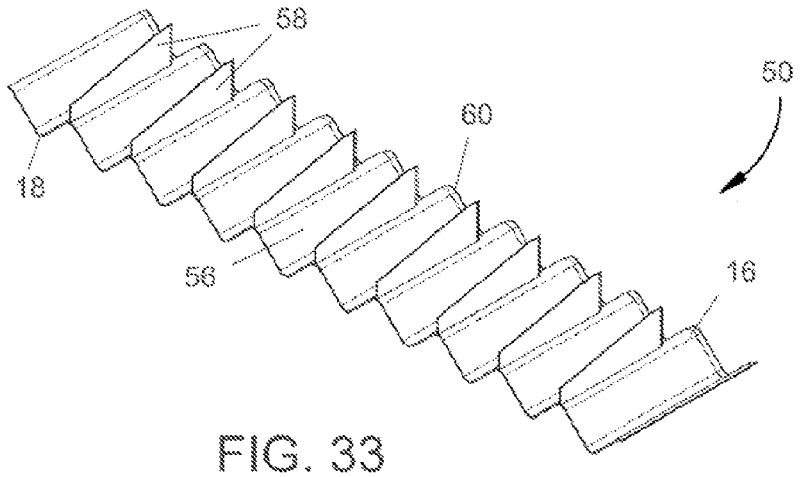
FIGS. 33 through 35 are perspective views representing shaped knives for producing large-amplitude shaped food products, including shaped shredded and shaped strip-cut food products in accordance with an aspect of this invention.
Figure 34:
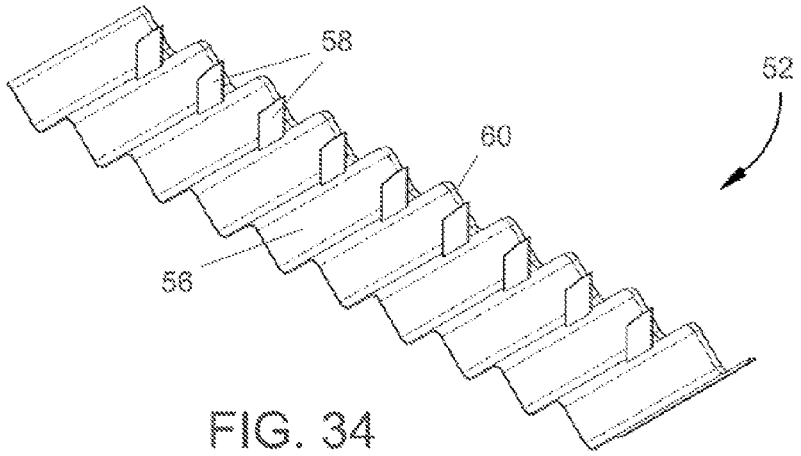
Figure 35:
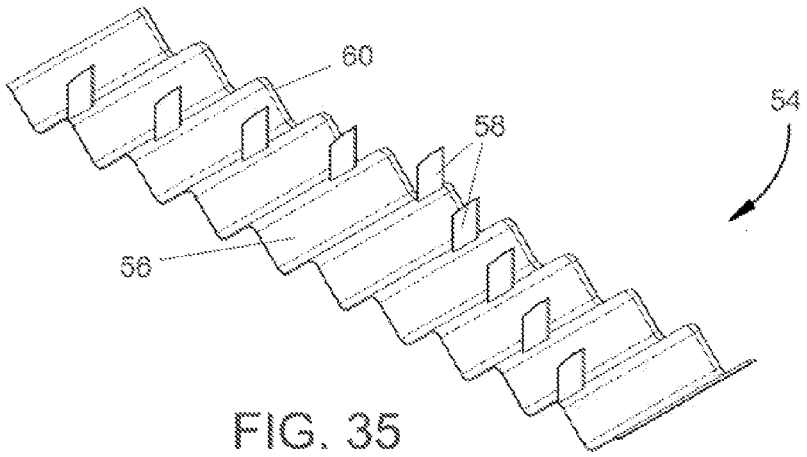
Figure 36:
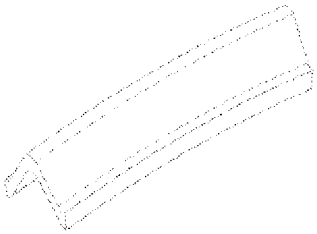
FIGS. 36 through 43 are perspective and cross-sectional views representing examples of shaped strip-cut food products that can be produced with knives of FIGS. 33 through 35 when sequential knives are in phase alignment.
Figure 37:
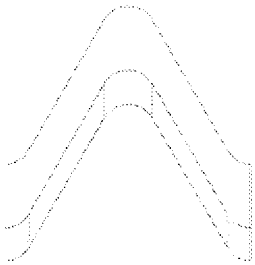
Figure 38:
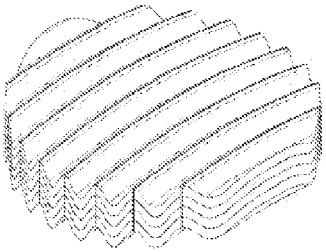
Figure 39:
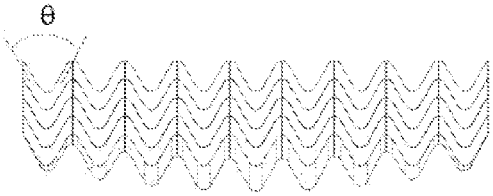
Figure 40:
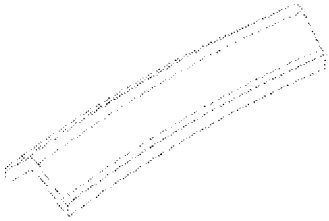
Figure 41:
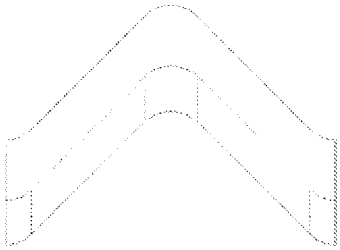
Figure 42:
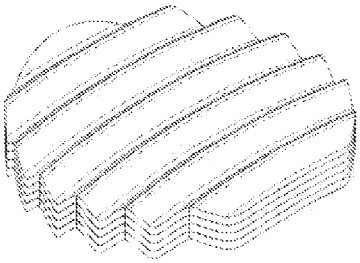
Figure 43:
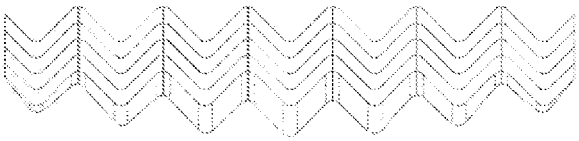

FIGS. 33 through 35 represent three embodiments of large-amplitude shaped (corrugated) knife assemblies proposed by the present invention for producing large-amplitude shaped food products, including shaped shredded and shaped strip-cut food products. One aspect of these knife assemblies is that the prior art practice of using a knife assembly comprising a shaped knife and a separate julienne knife is not used, and instead individual knives ("tabs") 58 are attached to the peaks 16 and/or valleys 18 of a shaped knife 56. A large-amplitude shaped knife assembly 50 with julienne tabs 58 is represented in FIG. 33, a large-amplitude shaped knife assembly 52 with relatively narrower julienne tabs 58 are represented in FIG. 34, and a large-amplitude shaped knife assembly 54 with narrower staggered julienne tabs 58 are represented in FIG. 35. The tabs 58 of FIG. 33 are represented as having a height from a surface of the knife 56 to the outermost extent of the julienne tab 58 that is a maximum in proximity to a leading edge 60 of the julienne tab 58 and continuously tapers to a minimum at or adjacent a trailing edge of the julienne tab 58. It will be appreciated that the tabs 58 of FIGS. 33 through 35 may be of any shape or size suitable for cutting the food product slices into strips. Unlike the knife assemblies represented in FIGS. 23 and 28, the knife assemblies 50, 52, and 54 have tabs 58 metallurgically joined to the knife 56 by any means known in the art, for example, welding and/or brazing.

In operation, the leading edge 60 of the knife 56 cuts a slice off of the food product, followed by the julienne tabs 58 that cut the slice into strips. FIGS. 36 through 43 show nonlimiting examples of shaped strip-cut food products that can be produced with knives of the type represented in FIGS. 33 through 35 when sequential knives are in phase alignment. FIGS. 36 through 39 represent shaped strip cut food products having included angles (represented in FIG. 39 as angle theta) of about sixty degrees. FIGS. 40 through 43 represent shaped strip cut food products having included angles of about ninety degrees. It is foreseeable that the present invention can be used to produce food products similar to FIGS. 36 through 43 with knives having included angles other than sixty or ninety degrees. From FIGS. 38, 39, 42, and 43, it can be seen that, in combination, the individual strips formed by during a single slice of the knife 56 aggregately or collectively define a periodic shape.

The wider julienne tabs 58 represented in FIG. 33 are believed to be more securely attached to the knife than the narrower tabs 58 represented in FIGS. 34 and 35 as more surface area of each wider tab 58 is secured to the knife 56 relative to the narrower tabs 58. However, wider tabs 58 may exert excessive forces on the food product slices. It is believed that, as a slice is produced by the knife 56, the slice has to deform around the thickness of individual tabs 58, creating pressure on the slice between adjacent tabs 58. If the pressure between the julienne tabs 58 is too great, the now-separated slice could slow and potentially stop before the julienne slices are complete. For this reason, the julienne tabs 58 are preferably constructed of the thinnest material possible while maintaining internal structural rigidity. Because the julienne tabs 58 of sequential knives 56 are also sequential, it may be desirable to narrow (as in FIG. 34) and/or stagger (as in FIG. 35) the tabs 58, that is, at differing distances from the leading edge of the knife 56, to minimize the pressure between adjacent tabs 58. However, the narrower julienne tabs 58 shown in FIGS. 34 and 35 have less surface area attached to the knife 56 than the wider tabs 58 of FIG. 33.

Figure 7:
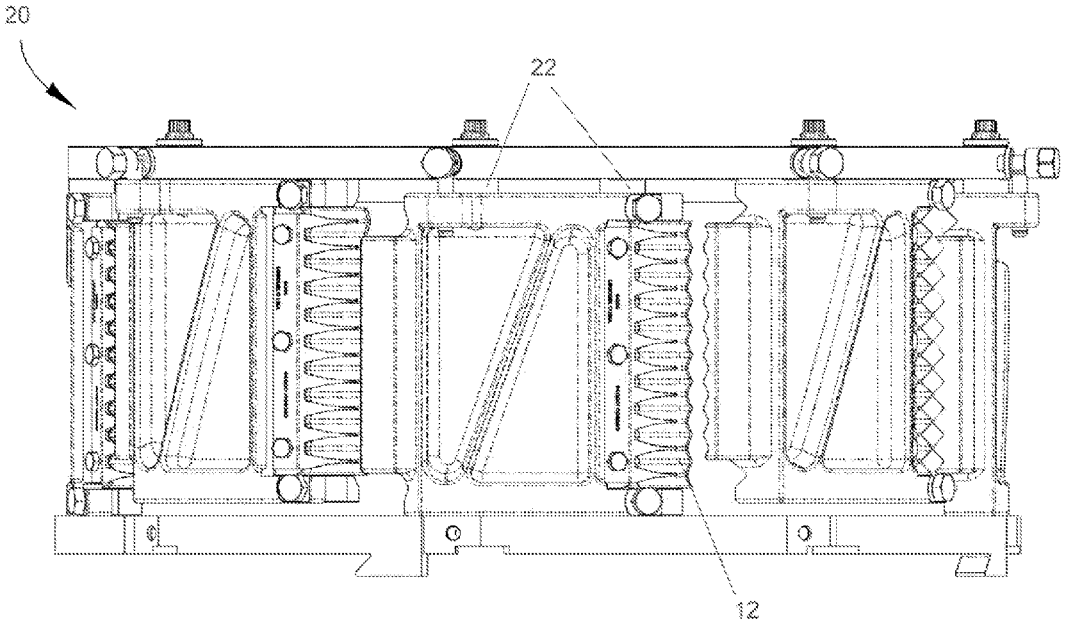
FIG. 7 (Prior Art)
FIG. 7 is a side view representing a cutting head of an existing Model CC® machine equipped with shaped knives arranged to be out of phase alignment for producing shaped shredded food products.
Figure 8:
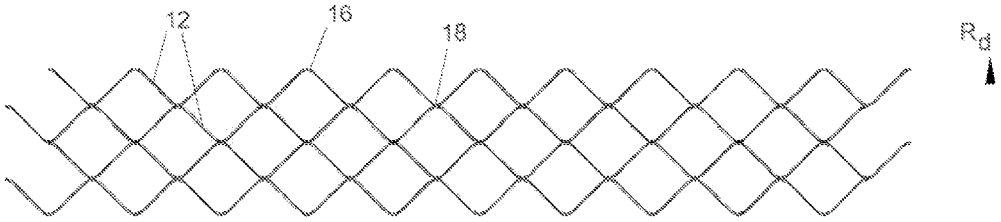
FIG. 8 (Prior Art)
FIG. 8 is a leading edge view representing sequential knives 180 degrees out of phase alignment for use with the cutting head of FIG. 7.
Figure 9:
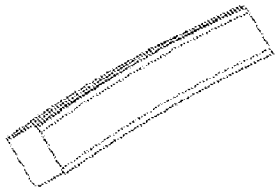
FIG. 9 (Prior Art)
FIGS. 9 through 12 are perspective and cross-sectional views representing examples of food products that can be produced with the cutting head of FIG. 7 and with the 180 degrees out of phase alignment knives of FIG. 8.
Figure 10:
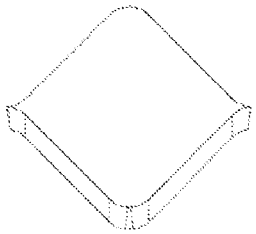
FIG. 10 (Prior Art)
Figure 11:
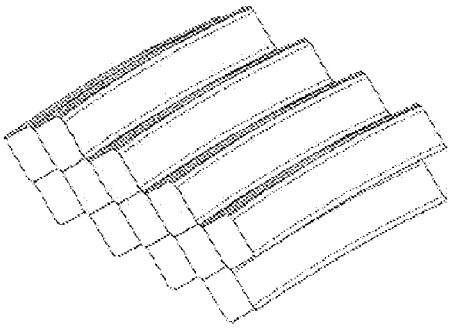
FIG. 11 (Prior Art)
Figure 12:
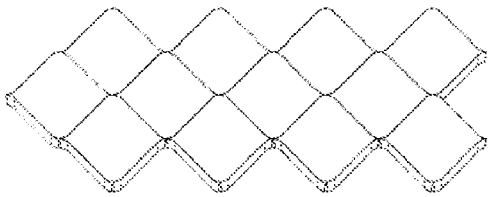
FIG. 12 (Prior Art)
Figure 44:
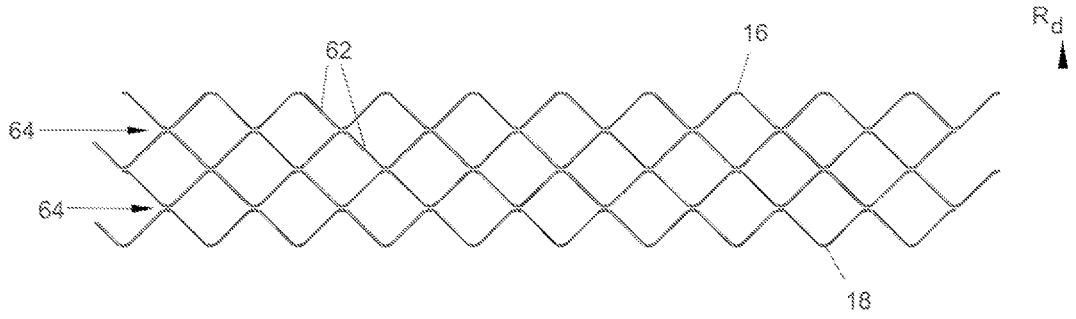
FIG. 44 is a leading edge view representing sequential knives 180 degrees out of phase alignment with a gap intentionally provided therebetween for use with the cutting head of FIG. 7 in accordance with an aspect of this invention.
Figure 45:
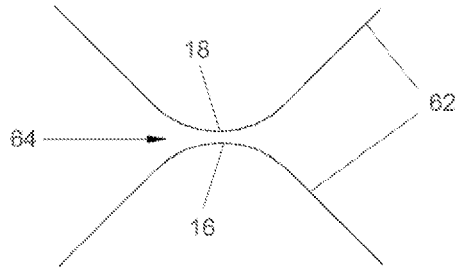
FIG. 45 is an detailed leading edge view representing the juxtaposed peak and valley of two sequential knives of FIG. 44.
Figure 46:
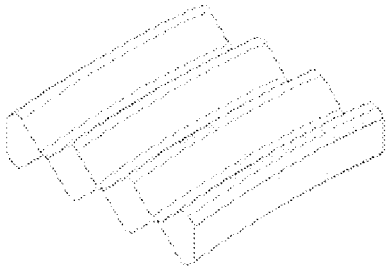
FIGS. 46 through 53 are perspective and cross-sectional views representing examples of food products that can be produced with the cutting head of FIG. 7 and with the 180 degrees out of phase alignment knives of FIG. 44.
Figure 47:
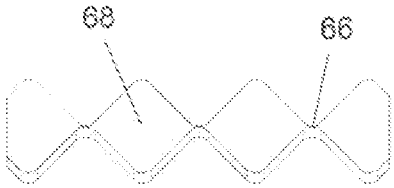
Figure 48:
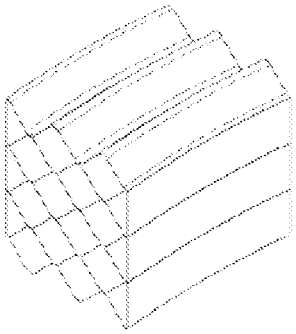
Figure 49:
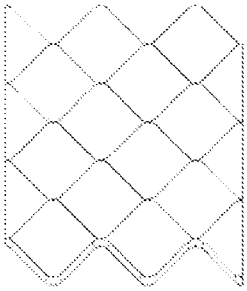
Figure 50:
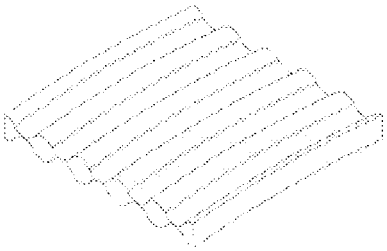
Figure 51:
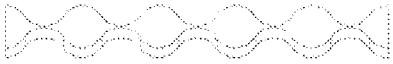
Figure 52:
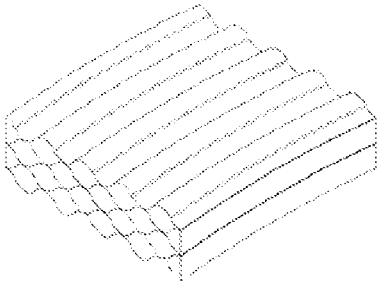
Figure 53:
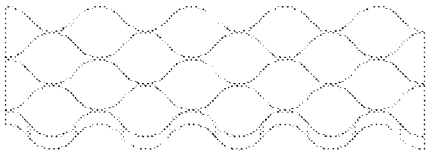

According to a second aspect of the invention, FIGS. 46 through 53 show nonlimiting examples of shaped shredded food products that can be produced with large-amplitude shaped (corrugated) knives 62 represented in FIG. 44 if sequential pairs of knives 62 are 180 degrees out of phase alignment, similar to what is shown in FIGS. 7 and 8. However, in large-amplitude food products of particular interest to the invention, the radial distance, measured in reference to mounting the knives 62 in the cutting head 20, of a valley 18 of a leading knife 62 does not necessarily need to equal the radial distance of the corresponding peak 16 of the next trailing knife 62 in sequence to produce a "full shred" discussed in reference to FIGS. 9 through 12. Instead, a gap 64 can be intentionally provided between the radial position of sequential knives 62 as represented in FIGS. 44 and 45 to create shaped food products having relatively thin first portions (webs) 66 between thicker second portions 68 as represented in FIG. 47. The relative thickness of the first and second portions 66 and 68 as used herein refers to measurements taken in a plane perpendicular to a cutting plane of the knives 62 and can be measured by the radial distance between adjacent sequential knives 62 when mounted within a cutting head of a type represented in FIGS. 1, 2, 7, and 22. FIGS. 50 through 53 represent food products produced by knives having larger corner radii and wider included angle cross-sections than the knives used to produce the food products of FIGS. 46-49. If the gap 64 is intentionally provided between sequential knives to produce non-large amplitude food products, it is believed that the thickness of the webs 66 would approach the thickness of the second portions 68 and the desired food product shapes, such as those represented in FIGS. 46 through 53.

Figure 1:
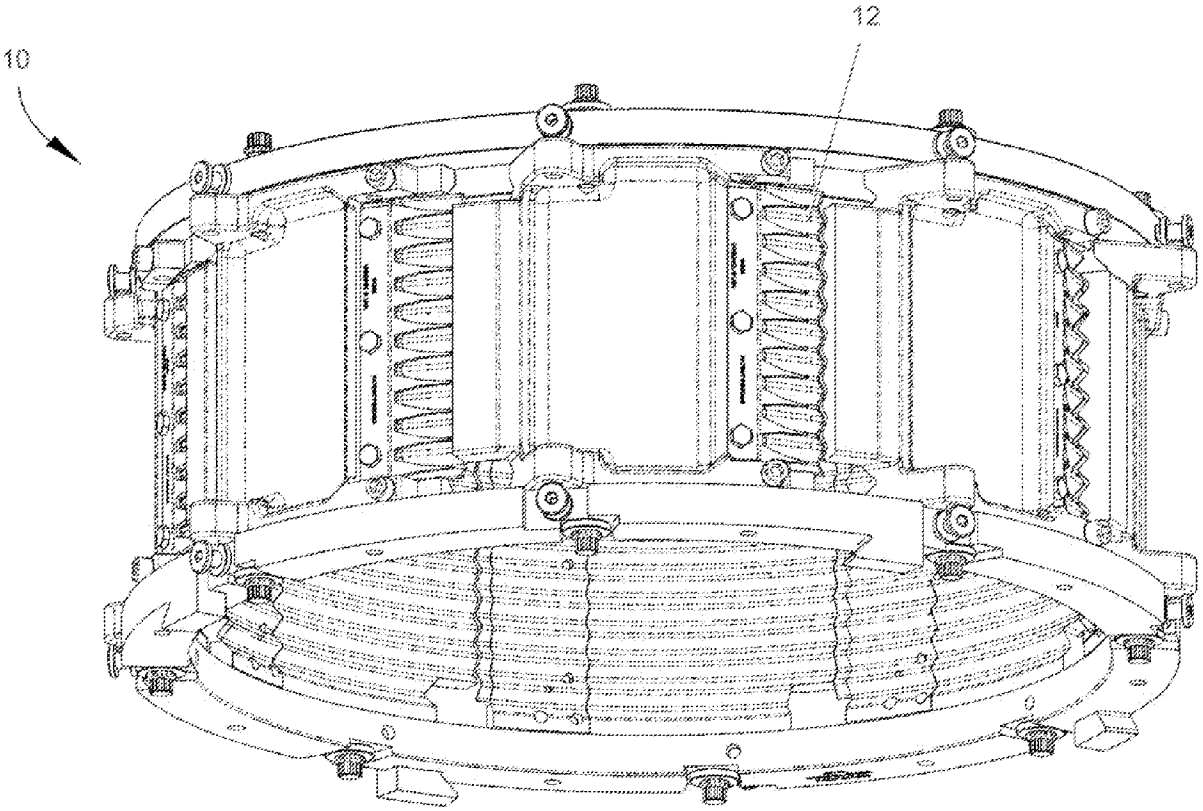
FIG. 1 (Prior Art)
FIGS. 1 and 2 are perspective and side views, respectively, representing a cutting head of an existing Model CC® machine equipped with shaped knives that are adapted for producing shaped sliced food products.
Figure 2:
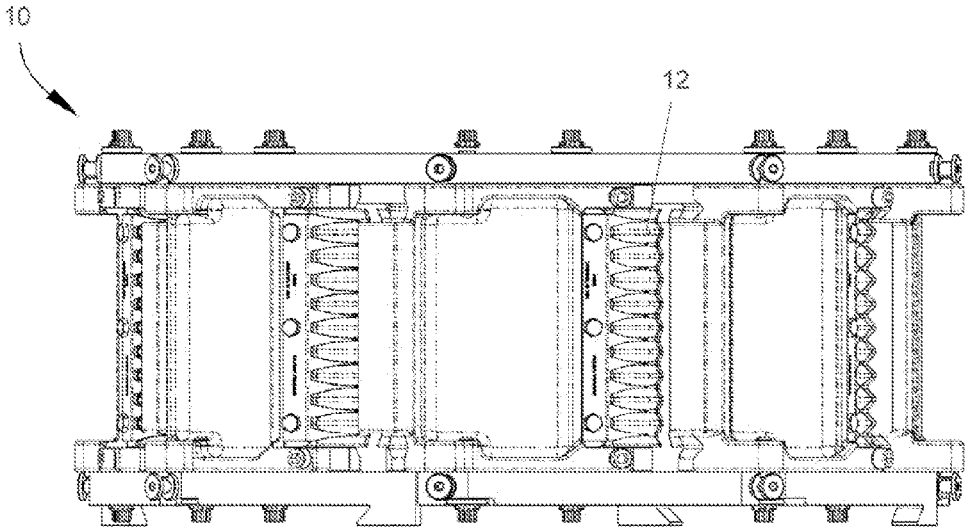
FIG. 2 (Prior Art)
Figure 3:
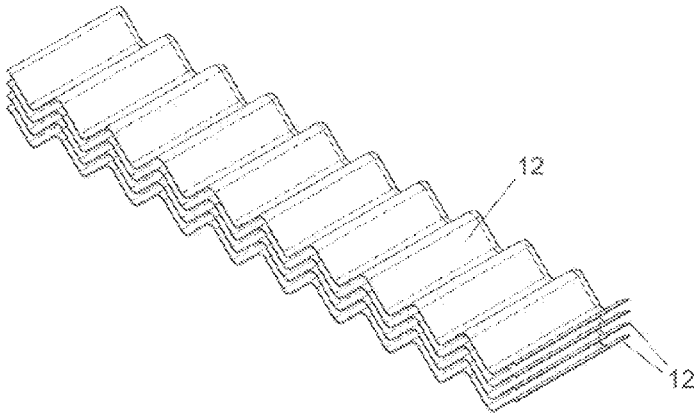
FIG. 3 (Prior Art)
FIGS. 3 and 4 are perspective and leading edge views, respectively, representing sequential knives in phase alignment for use with the cutting head of FIGS. 1 and 2.
Figure 4:
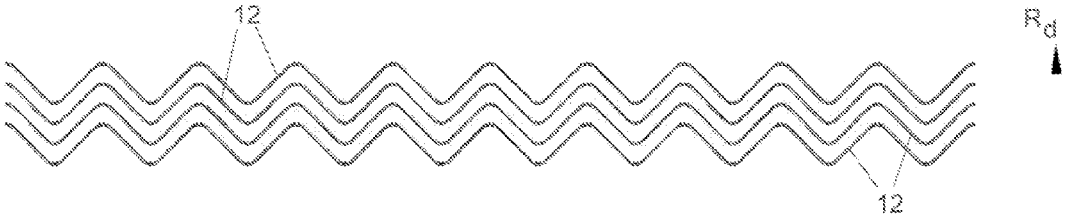
FIG. 4 (Prior Art)
Figure 5:
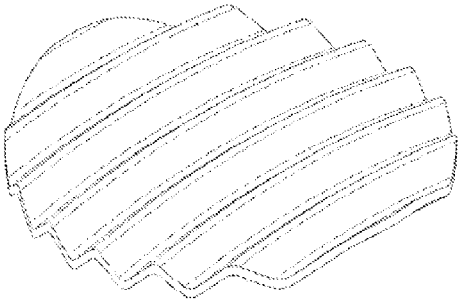
FIG. 5 (Prior Art)
FIGS. 5 and 6 are perspective and cross-sectional views, respectively, representing examples of food products that can be produced with the cutting head of FIGS. 1 and 2 and with the phase-aligned knives of FIGS. 3 and 4.
Figure 6:
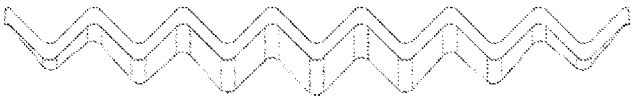
FIG. 6 (Prior Art)
Figure 13:
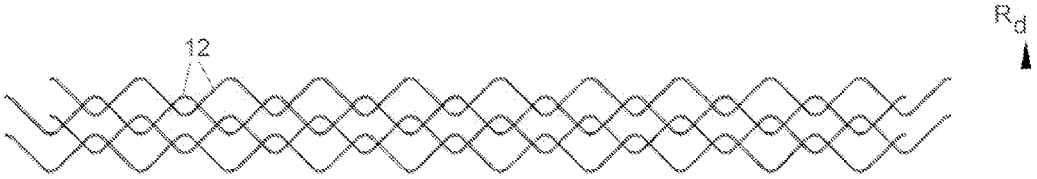
FIG. 13 (Prior Art)
FIG. 13 is a leading edge view representing sequential knives 180 degrees out of phase alignment for use with the cutting head of FIG. 7.
Figure 14:
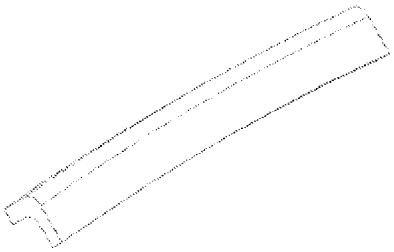
FIG. 14 (Prior Art)
FIGS. 14 through 21 are perspective and cross-sectional views representing examples of food products that can be produced with the cutting head of FIG. 7 and with the 180 degrees out of phase alignment knives of FIG. 13.
Figure 15:
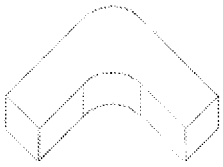
FIG. 15 (Prior Art)
Figure 16:
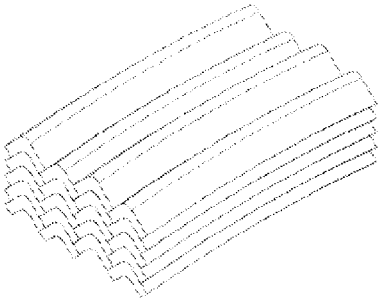
FIG. 16 (Prior Art)
Figure 17:
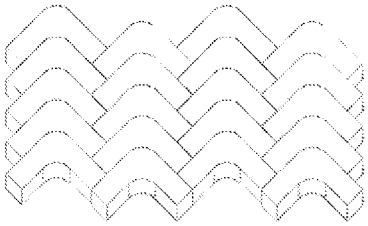
FIG. 17 (Prior Art)
Figure 18:
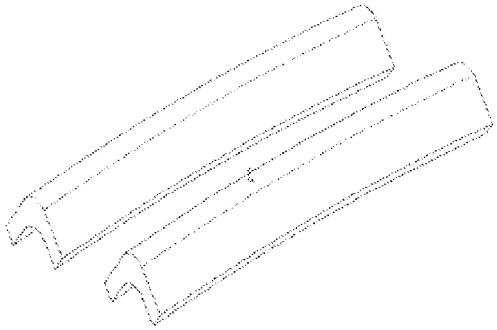
FIG. 18 (Prior Art)
Figure 19:
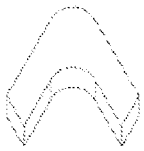
FIG. 19 (Prior Art)
Figure 20:
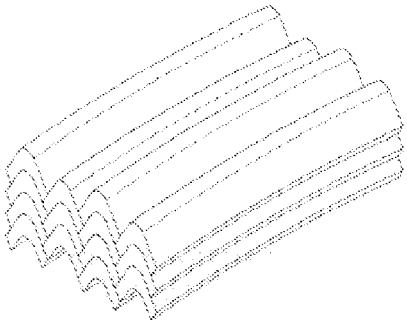
FIG. 20 (Prior Art)
Figure 21:
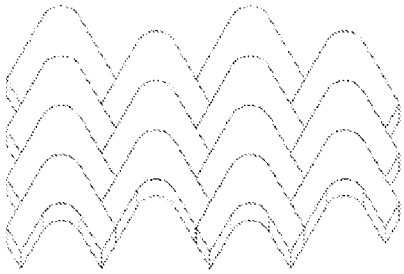
FIG. 21 (Prior Art)
Figure 22:
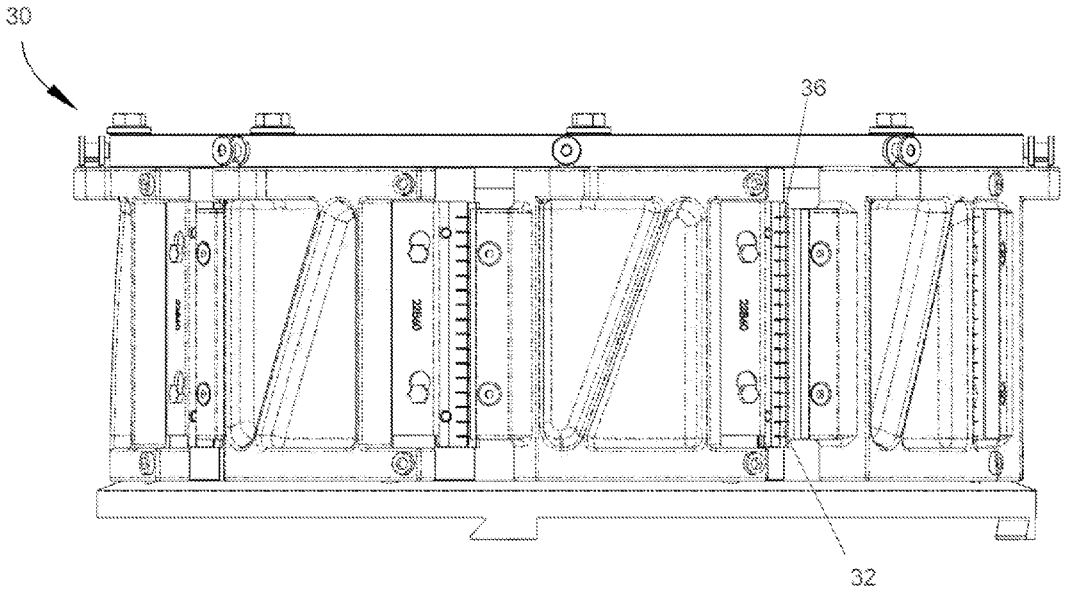
FIG. 22 (Prior Art)
FIG. 22 is a side view representing a cutting head of an existing Model CC® machine equipped with knife assemblies that are adapted for producing flat strip-cut food products.
Figure 54:
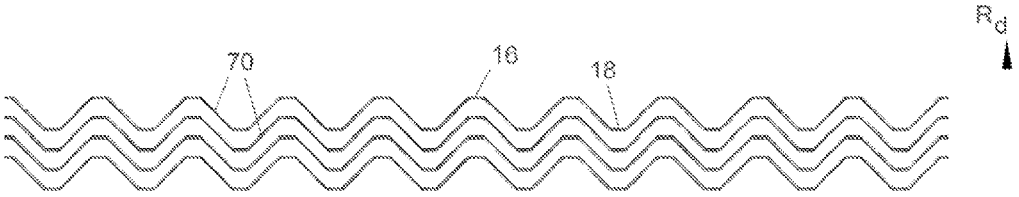
FIG. 54 is a leading edge view representing sequential knives in phase alignment to produce shaped slices for use with the cutting head of FIGS. 1 and 2 in accordance with an aspect of this invention.
Figure 55:
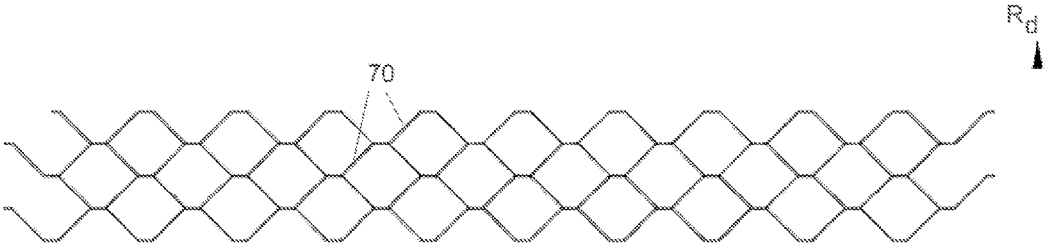
FIG. 55 is a leading edge view representing sequential knives 180 degrees out of phase alignment for use with the cutting head of FIG. 7 to produce shaped full-shreds in accordance with an aspect of this invention.
Figure 56:
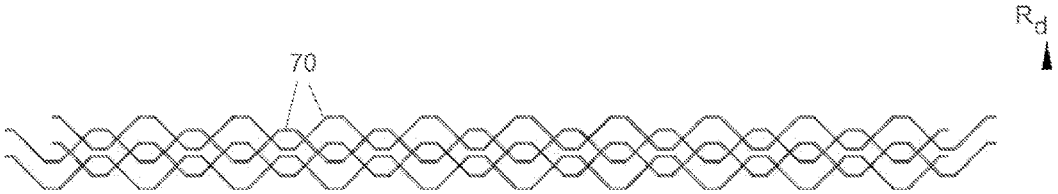
FIG. 56 is a leading edge view representing sequential knives 180 degrees out of phase alignment for use with the cutting head of FIG. 7 to produce shaped reduced-shreds in accordance with an aspect of this invention.
Figure 57:
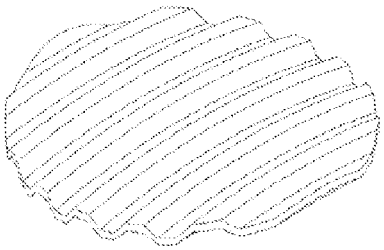
FIGS. 57 through 60 are perspective and cross-sectional views representing examples of food products that can be produced with the cutting head of FIGS. 1 and 2 and with phase-aligned knives of FIG. 54.
Figure 58:
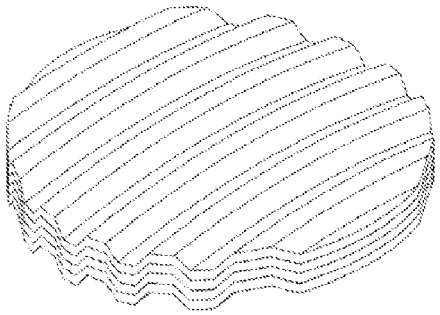
Figure 59:
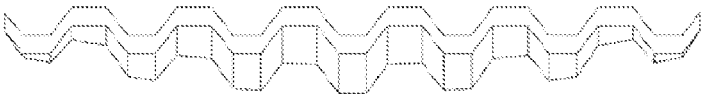
Figure 60:
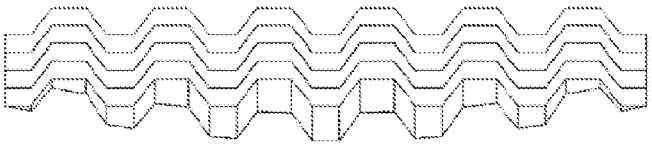
Figure 61:
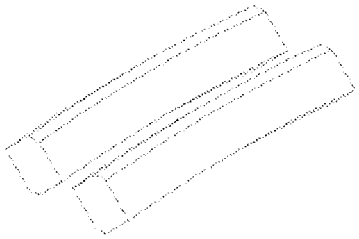
FIGS. 61 through 68 are perspective and cross-sectional views representing examples of food products that can be produced with the cutting head of FIG. 7 and with the 180 degrees out-of-phase alignment knives shown in FIG. 55.
Figure 62:
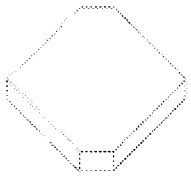
Figure 63:
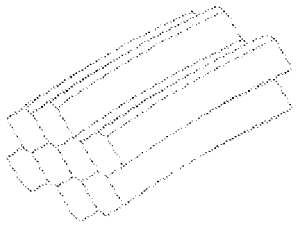
Figure 64:
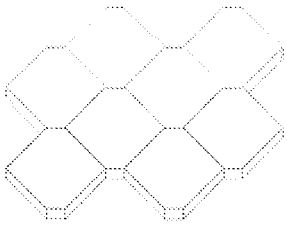
Figure 65:
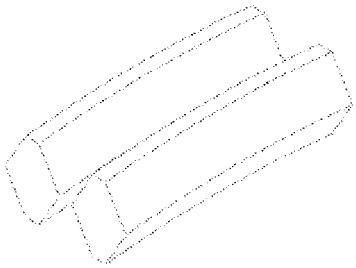
Figure 66:
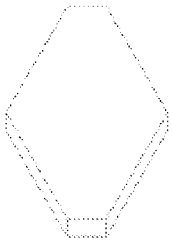
Figure 67:
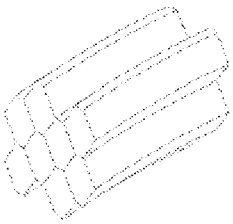
Figure 68:
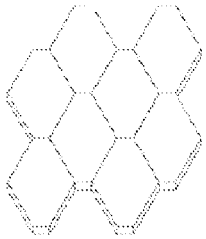
Figure 69:
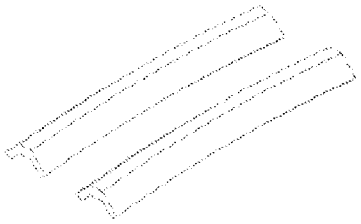
FIGS. 69 through 76 are perspective and cross-sectional views representing examples of food products that can be produced with the cutting head of FIG. 7 and with the 180 degrees out-of-phase alignment knives shown in FIG. 56.
Figure 70:
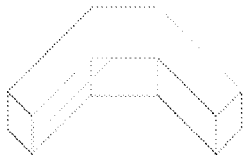
Figure 71:
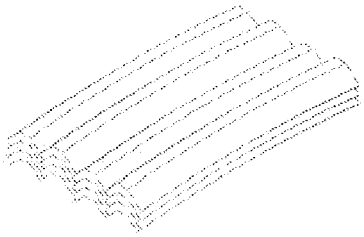
Figure 72:
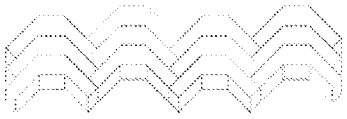
Figure 73:
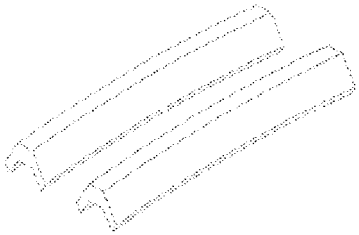
Figure 74:
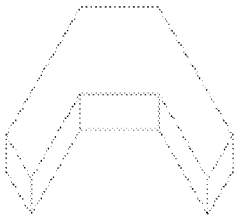
Figure 75:
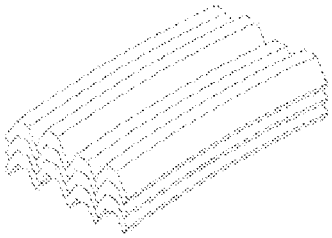
Figure 76:
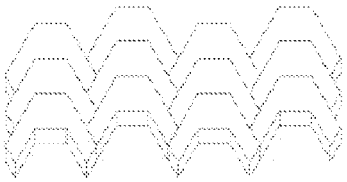
Figure 77:
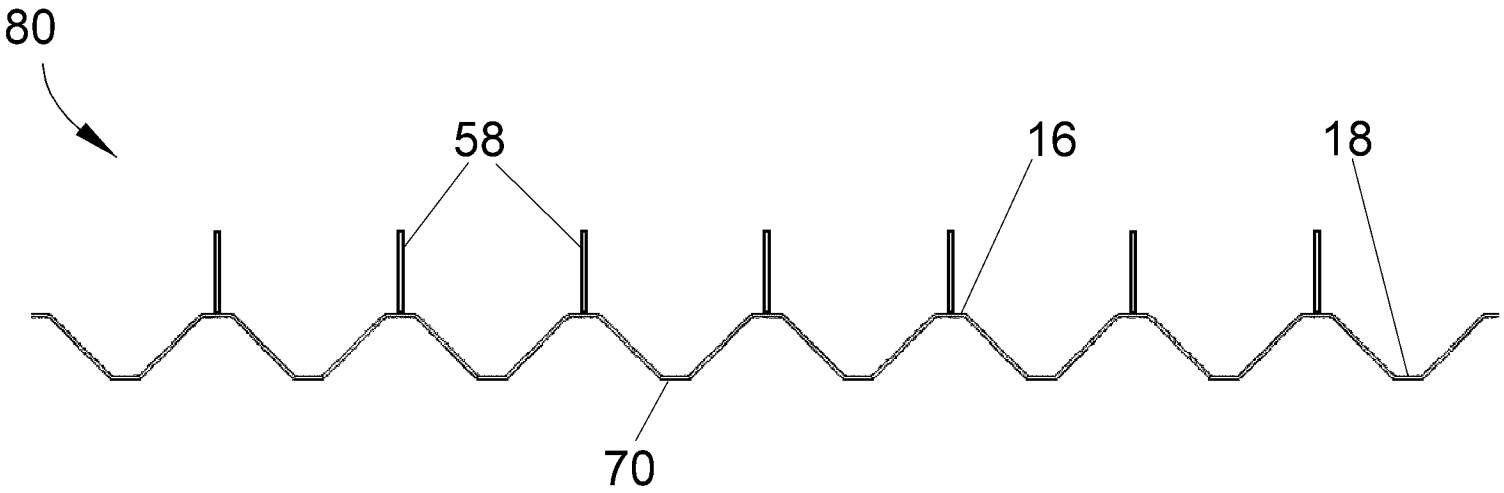
FIG. 77 is a leading edge view representing shaped knives for producing large-amplitude shaped food products, including shaped shredded and shaped strip-cut food products in accordance with an aspect of this invention.

According to a third aspect of the invention, FIGS. 54 through 56 visually represent large-amplitude shaped (corrugated) knives 70 that are, respectively, in phase alignment to produce shaped slices (similar to FIG. 4), 180 degrees out of phase alignment to produce shaped full-shreds (similar to FIGS. 8), and 180 degrees out of phase overlapping alignment to produce shaped reduced-shreds (similar to FIG. 13). However, the shapes of the knives 70 are modified to have flat peaks 16 and valleys 18 instead of radii. FIGS. 57 through 60 represent examples of shaped sliced food products that can be produced with the phase-aligned knives70 shown in FIG. 54. FIGS. 61 through 68 represent examples of shaped full-shred food products that can be produced with the 180 degrees out-of-phase alignment knives 70 shown in FIG. 55. The food products of FIGS. 61 through 70 were produced with knives having included angles of about ninety degrees and the food products of FIGS. 65 through 68 were produced with knives having included angles of about sixty degrees. FIGS. 69 through 76 represent examples of shaped reduced-shred food products that can be produced with the overlapping 180 degrees out-of-phase alignment knives 70 shown in FIG. 56. The food products of FIGS. 69 through 72 were produced with knives having included angles Of about ninety degrees and the food products of FIGS. 65 through 68 were produced with knives included angles of about sixty degrees. Additional food product shapes may be produced by intentionally leaving a gap 64 between the sequential knives of FIG. 55 similar to the described phase alignment of FIGS. 44 through 53. In addition to the above, the knives 70 of FIGS. 54 through 56 may comprise tabs 58 as previously described in reference to FIGS. 33 through 43 to produce shaped strip-cut food products. A nonlimiting example of such a knife 80 is represented in FIG. 77.

While the invention has been described in terms of specific embodiments, it is apparent that other forms could be adopted by one skilled in the art. For example, the knife assemblies and the apparatus in which they are installed could differ in appearance and construction from the knife assemblies and cutting heads shown in the drawings, and materials and processes other than those noted could be used. Therefore, the scope of the invention is to be limited only by the following claims.

The invention claimed is:

1. A knife assembly adapted for installation in a centrifugal-type cutting apparatus and cutting food product in the centrifugal-type cutting apparatus, the knife assembly comprising:

a knife having a corrugated shape to produce a large-amplitude food product slice having a periodic shape, the corrugated shape having peaks and valleys to produce the periodic shape, each of the peaks and each of the valleys having a convex side and an oppositely-disposed concave side, the convex side of each peak having an apex;

a julienne tab metallurgically joined to the apex at the convex side of at least a first of the peaks of the knife by a metallurgical joint, the julienne tab extending in a direction away from the concave side of the first peak, the julienne tab being oriented along the apex of the first peak to cut the food product slice into strips.

2. The knife assembly of claim 1, wherein the food product slice has an amplitude of about 2.5 mm or more.

3. The knife assembly of claim 1, wherein the knife assembly is adapted to produce shaped shredded and/or shaped strip-cut food products.

4. The knife assembly of claim 1, wherein the julienne tab has a height from a surface of the knife to the outermost extent of the julienne tab that is a maximum adjacent a leading edge of the julienne tab and is a minimum adjacent a trailing edge of the julienne tab.

5. The knife assembly of claim 1, wherein the knife assembly comprises at least two julienne tabs and adjacent julienne tabs are located at differing distances from a leading edge of the knife.

6. The knife assembly of claim 1, wherein the corrugated shape comprises flat peaks and/or valleys adapted to produce the food product slice wherein the periodic shape thereof has flat peaks and/or valleys.

* * * * *